US006367355B1

(12) United States Patent
Tanné

(10) Patent No.: US 6,367,355 B1
(45) Date of Patent: Apr. 9, 2002

(54) UNIVERSAL WRENCH FOR TIGHTENING AND LOOSENING POLYGONAL ASSEMBLY ELEMENTS

(76) Inventor: Marc Tanné , Rue des Brévards 10, CH-2000 Neuchâtel (CH)

( * ) Notice: Subject to any disclaimer, the term of this patent is extended or adjusted under 35 U.S.C. 154(b) by 0 days.

(21) Appl. No.: 09/559,539

(22) Filed: Apr. 28, 2000

(30) Foreign Application Priority Data

Apr. 30, 1999 (EP) ..... 99108439

(51) Int. Cl.[7] ..... B25B 13/52
(52) U.S. Cl. ..... 81/64; 81/65
(58) Field of Search ..... 81/64, 65, 68, 81/69

(56) References Cited

U.S. PATENT DOCUMENTS

| | | | | | |
|---|---|---|---|---|---|
| 1,051,562 | A | * | 1/1913 | Crolla et al. | 81/64 |
| 1,456,126 | A | | 5/1923 | Friday | |
| 1,464,128 | A | * | 8/1923 | Coes | 81/64 |
| 1,610,387 | A | * | 12/1926 | Pennington | 81/64 |
| 1,706,411 | A | | 3/1929 | Pfaff | |
| 1,792,401 | A | | 2/1931 | Sorensen et al. | |
| 1,797,446 | A | * | 3/1931 | Salmon | 81/64 |
| 1,828,106 | A | | 10/1931 | Ertola | |
| 1,911,815 | A | | 5/1933 | Deringer et al. | |
| 2,200,093 | A | | 5/1940 | McNeil | |
| 2,303,579 | A | * | 12/1942 | Ramoneda | 81/64 |
| 2,481,055 | A | | 9/1949 | Whitaker | |
| 2,498,582 | A | | 2/1950 | Schoenberger | |
| 2,522,190 | A | | 9/1950 | Mouser | |
| 2,706,423 | A | * | 4/1955 | Rose | 81/487 |
| 4,160,394 | A | * | 7/1979 | Crumpacker | 81/64 |
| 5,097,729 | A | | 3/1992 | Brown | |

* cited by examiner

*Primary Examiner*—Joseph J. Hail, III
*Assistant Examiner*—David B. Thomas
(74) *Attorney, Agent, or Firm*—Sughrue Mion, PLLC

(57) ABSTRACT

A universal wrench is described for tightening or loosening polygonal assembly elements, such as nuts, bolt heads or polygonal tube sleeves. This universal wrench includes a wrench body provided with a handle (1) and a wrench head (2) intended to come into contact with a polygonal assembly element (5) to be tightened or loosened, said wrench head including a support body (20) able to accommodate said polygonal assembly element. The wrench further includes a flexible strap-shaped element (3) intended to surround and hold the polygonal assembly element against the support body and tension means for the strap. The wrench head is also rotatably mounted with respect to the handle so as to allow an increase in the tension of the strap when a rotational movement is applied to the assembly element and to allow the strap to relax during an opposite movement.

20 Claims, 3 Drawing Sheets

Fig.3a
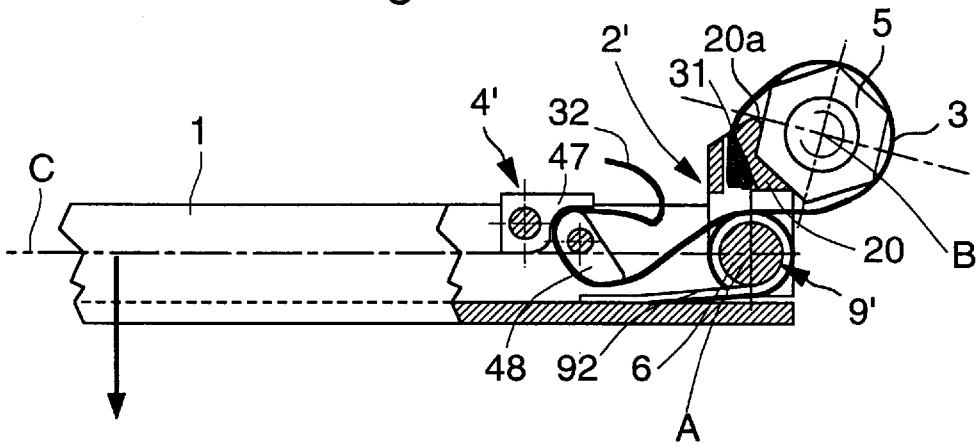
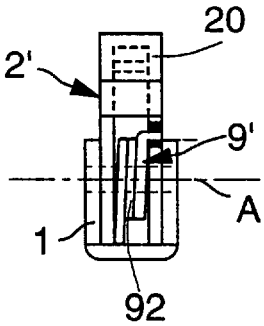
Fig. 3b
Fig. 4
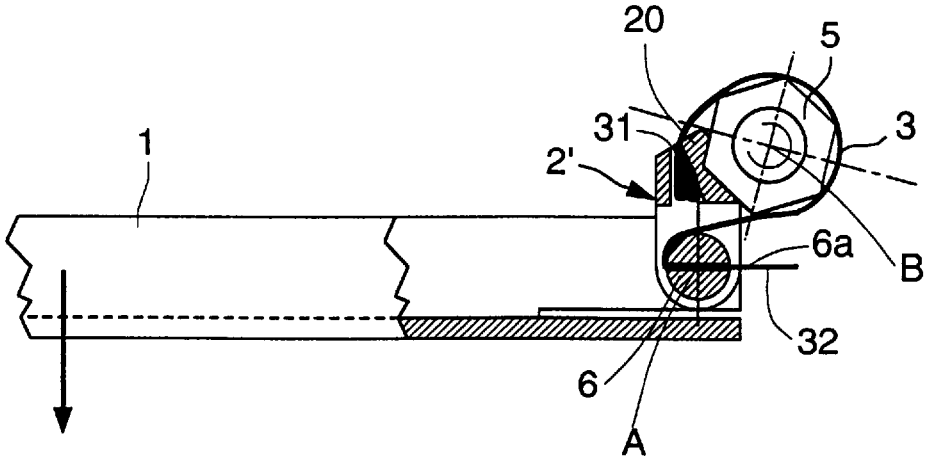

UNIVERSAL WRENCH FOR TIGHTENING AND LOOSENING POLYGONAL ASSEMBLY ELEMENTS

BACKGROUND OF THE INVENTION

The present invention concerns a universal wrench for tightening and loosening polygonal assembly elements, such as nuts, bolt heads or polygonal tube sleeves.

Universal wrenches provided with gripping mechanisms with adjustable rigid jaws such as adjustable or rack spanners are already known. These wrenches or spanners require a large clearance around the assembly element which has to be gripped. In this case, the gripping of the assembly element is essentially effected laterally in order to hold it securely.

Strap or band wrenches which allow objects of large diameter to be tightened and loosened are also known. This type of wrench is typically for dismantling tubular assemblies, automobile vehicle filters or receptacle caps for example. In this case, gripping is effected by the friction of the strap on the surface of the assembly element. The strap thus preferably has a high friction coefficient in order to transmit the necessary tightening or loosening torque. As will easily be understood, the torque transmitted by friction by means of this type of wrench can thus be reduced by any grease, oil or dirt present which has the effect of reducing the friction between the contact surfaces of the assembly element and the strap. This reduction is all the more probable given that the wrenches are typically inserted or used in environments where such grease, oil or dirt are highly likely to be present.

The diameter of the assembly element also plays an important role since the torque transmitted is directly dependent on said diameter. For a given torque, the force to be applied to the assembly element is in fact inversely proportional to the diameter of the assembly element. By way of example, to transmit a torque of 5 Nm to an assembly element with a diameter of 10 mm the effort applied will be 1000 N. It will thus be understood that if such wrenches are perfectly suitable for applications for demounting filters or tubular assemblies, this is not however the case if one attempts to use this type of wrench for tightening or loosening assembly elements of smaller diameter such as bolt heads or nuts.

Associated with any presence of grease or oil or other friction reducing substances, the small diameter of the assembly elements makes this type of wrench practically unusable for tightening or loosening bolt heads, nuts or other similar polygonal assembly elements.

Another difficulty related to gripping assembly elements such as bolt heads or nuts lies in the small space available in height for gripping to be performed.

SUMMARY OF THE INVENTION

The main object of the present invention is thus to provide a universal wrench particularly suited to tightening or loosening polygonal assembly elements such as nuts, bolt heads or polygonal tube sleeves.

Another object of the present invention is also to assure an adequate and optimum grip of the wrench on the assembly element to be tightened or loosened during a tightening or loosening rotational movement.

A further object of the invention is to provide a universal wrench which is easy to use and in particular allows polygonal elements located in inaccessible positions to be tightened or loosened.

The present invention thus concerns a universal wrench for tightening or loosening polygonal assembly elements, such as nuts, bolt heads or polygonal tube sleeves, this universal wrench including a wrench body provided with a handle and a wrench head arranged at one end of the handle and intended to come into contact with a polygonal assembly element to be tightened or loosened, the wrench head including a support body able to accommodate the polygonal assembly element, wherein the wrench further includes a flexible strap-shaped element intended to surround and hold the polygonal assembly element against the support body, one of the ends of the flexible strap-shaped element being fixed to the wrench head, and tension means associated with the handle and intended to act on the other end of the flexible strap-shaped element in order to place and hold the flexible strap-shaped element under tension, the wrench head being rotatably mounted with respect to the handle about a rotational axis parallel to the rotational axis of the polygonal assembly element to be tightened or loosened, so that a tightening or loosening rotational movement causes an increase in the tension of the flexible strap-shaped element thus assuring that the wrench is held gripped on the polygonal assembly element, and so that a so-called return rotational movement opposite to the tightening or loosening rotational movement causes the flexible strap-shaped element to relax thus allowing the wrench head to slide and grip another angle of the polygonal assembly element.

The solution provided by the present invention thus allows the assembly element to be gripped laterally like a wrench provided with adjustable jaws. The tightening and loosening torque is thus transmitted to the assembly element not by friction between the strap-shaped element and the object to be tightened or loosened as in strap or band wrenches of the prior art, but by a direct mechanical connection between the wrench head and the assembly element being gripped.

According to the present invention, because the wrench head is rotatably mounted with respect to the wrench handle so that a tightening or loosening rotational movement causes an increase in the tension of the flexible strap-shaped element and because an opposite rotational movement to the tightening or loosening rotational movement causes the flexible strap-shaped element to relax, it is not necessary to adjust the grip of the wrench on the assembly element since the latter is automatically disengaged during the opposite rotational movement to the tightening or loosening rotational movement in order to allow the latter to slide onto the polygonal assembly element and to grip another angle thereof. This is particularly advantageous in the event that the assembly element is located in an inaccessible position or if the rotational angle which it is possible to apply to the assembly element is limited.

It will be understood that, according to the present invention, the tightening rotational movement, the loosening rotational movement and the return rotational movement (that is a rotation movement opposite to a tightening or loosening rotational movement) depend on the position of the wrench with respect to the assembly element. It thus possible to apply a tightening rotational movement to the assembly element by disposing the wrench in a first position, and to apply a loosening rotational movement to the assembly element by disposing the wrench in a position opposite and symmetrical to the first position of the wrench. The return rotational movement is always defined as a rotational movement opposite to a tightening rotational movement, respectively to a loosening rotational movement, whether one wishes to tighten or respectively loosen the polygonal assembly element.

Advantageous embodiments of the present invention are the subject of dependent claims.

In particular, according to one embodiment of the invention, the wrench is preferably provided with return means linking the wrench head to the handle in an resilient manner in order to place the flexible strap-shaped element automatically under stress during an opposite rotational movement to the tightening or loosening rotational movement. Consequently, the wrench behaves like a ratchet handle, i.e. the wrench is held gripping the assembly element when the latter is subjected to a tightening or loosening rotational movement and can however slide or jump an angle of the polygonal assembly element when it is subjected to a rotational movement of relaxation or return rotational movement opposite to the tightening or loosening rotational movement, the wrench head again gripping another angle of the assembly element via the action of the return means, these means thereby placing the flexible strap-shaped element under tension.

Other advantageous embodiments will be presented in the following description.

Moreover, the flexible strap-shaped element can advantageously be made of a textile material, for example aramid fibres such as Kevlar (registered trademark).

BRIEF DESCRIPTION OF THE DRAWINGS

Other features and advantages of the invention will appear more clearly upon reading the following detailed description, made with reference to the annexed drawings given by way of non-limiting example and in which:

FIGS. 3*a* and 3*b* respectively show a side view and a front view of a second embodiment of a universal wrench according to the present invention; and FIG. 4 shows a third embodiment of the present invention similar to the second embodiment of FIGS. 3*a* and 3*b*.

DETAILED DESCRIPTION OF THE INVENTION

Figure 1A:
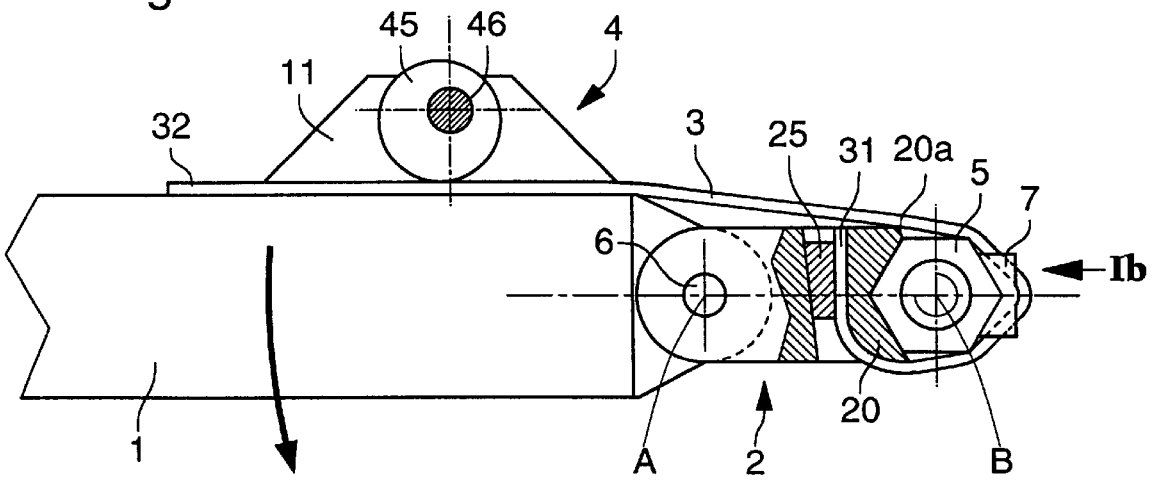
FIGS. 1*a* to 1*c* illustrate a side view and a front view of a universal wrench constituting a first embodiment of the present invention as well as a detailed view of a counterpart able to be used in this embodiment.
Figure 1B:
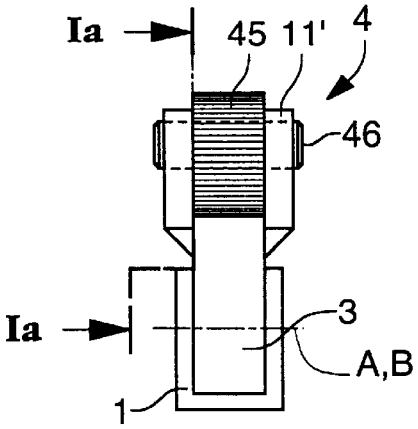

FIGS. 1*a* and 1*b* illustrate a universal wrench constituting a first embodiment of the present invention. This wrench essentially includes a wrench body including in particular a handle 1 and a wrench head 2 intended to come into contact with a polygonal assembly element 5 to be screwed or unscrewed, a flexible strap-shaped element 3, hereinafter called a strap for the purpose of simplification, capable of surrounding assembly element 5 as well as tension means 4 for the strap. Polygonal assembly element 5 illustrated by way of non-limiting example in the Figures is formed of a nut with six flats.

More particularly, head 2 is arranged at one end of handle 1 and is rotatably mounted with respect to handle 1 about a rotational axis designated A in the Figures, this rotational axis A being substantially parallel to the rotational axis, designated B, of assembly element 5 to be tightened or loosened. Wrench head 2 may for example be rotatably mounted with respect to handle 1 via an articulation pin, designated 6. Wrench head 2 includes a support body 20 for assuring contact with assembly element 5. This support body 20 is arranged so as to transmit a tightening or loosening torque independently of the friction between assembly element 5 and strap 3. It thus preferably includes two support faces 21 and 22 forming an angle substantially equal to the angle formed by two successive faces of assembly element 5, namely, in this non-limiting example, an angle substantially equal to 120° formed between two successive flats of the nut. Alternatively, one could envisage designing a support body in which the angle formed by these support faces 21 and 22 is adjustable according to the type of polygonal assembly element.

By way of improvement, at least one support face of support body 20 may be made rough in order to increase the adherence of the wrench head to polygonal assembly element 5.

Strap 3 is secured by one of its ends 31 to wrench head 2, the other end 32 of strap 3 being adapted to be held by tension means associated with handle 1 globally designated by the reference 4. In the example illustrated in FIGS. 1*a* and 1*b*, strap end 31 is secured to wrench head 2 via a key or wedge 25 pinching this end against a face of a recess 26 arranged in wrench head 2. It will be noted that it may be envisaged to not use key 25, and to provide a thickening or excessive thickness of strap 3, in particular by folding back end 31. By way of example, the second and third embodiments illustrated respectively in FIGS. 3*a*, 3*b* and 4 show how end 31 of strap 3 can be held via an excessive thickness of strap 3. Alternatively, it will of course be understood that it is possible to assure the securing of end 31 by other suitable means, such as for example riveting, screwing or even bonding strap end 31 onto wrench head 2. The mode of securing end 31 of strap 3 shown in FIG. 1*a* is thus in no way limiting.

The other end 32 of strap 3 is arranged, in this illustration, to slide or pass through tension means 4 formed, in this example, of a moving element in the form of a cam or eccentric 45 in rotation about a pin 46 mounted on a projecting portion 11 of handle 1. Cam 45 holds and locks end 32 of strap 3 by pinching it against handle 1 of the wrench. As will easily be understood, strap 3 is held by exerting traction on end 32 of strap 3 then locked by a rotational movement of cam 45 about its pin 46 in the direction of wrench head 2. It will be noted that various other locking mechanisms fulfilling the same function may easily be envisaged by those skilled in the art. One will therefore not dwell on the various solutions which may be envisaged to allow strap 3 to be placed and kept under tension. FIGS. 3*a* and 4 show by way of illustration two other solutions allowing strap 3 to be placed and kept under tension.

By means of the universal wrench illustrated in FIGS. 1*a* and 1*b*, polygonal assembly element 5 is thus gripped and held in contact against support body 20 of wrench head 2 via the action of strap 3 which, once rolled around assembly element 5, is tightened and kept under tension with the aid of tension means 4. In other words, strap 3 holds assembly element 5 against support body 20 of wrench head 2 laterally like pliers. By a rotational movement of the wrench in the direction indicated by the arrow in the Figure, assembly element 5 is thus subjected to a loosening torque in the position illustrated in FIG. 1*a*. In order to tighten assembly element 5, the wrench must of course be arranged in the opposite position to that illustrated in FIG. 1*a*.

More particularly, a tightening or loosening rotational movement cause an increase in the tension of strap 3 and consequently an improvement in the grip of the wrench on assembly element 5. Conversely, an opposite rotational movement to the tightening or loosening rotational movement, called a relaxation or return rotational movement, causes the strap to relax around polygonal assembly element 5, so that the wrench is able to slide or jump over the surface of the assembly element and grip another angle thereof.

By way of improvement, a bevelled or rounded edge may be provided at one end, designated 20*a* in FIG. 1*a*, of support body 20 in order to facilitate the sliding of the head during the return rotational movement.

It should be noted generally, that the tension means illustrated in the embodiment act in a self-locking manner when a tightening or loosening torque is applied to the assembly element. These simple means thus assure an optimum grip of the wrench on assembly element 5. It will be noted again that using a multitude of other mechanisms fulfilling the same function, may however be envisaged, such as loop or notch mechanisms to achieve suitable locking of the strap.

Figure 1C:
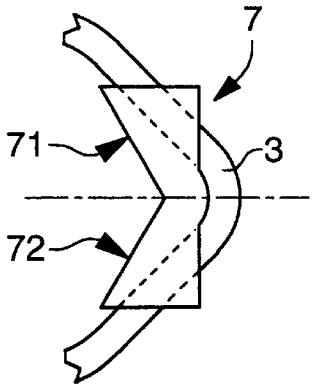

The universal wrench of FIGS. 1*a* and 1*b* may also include, as is illustrated, as a complement to support head 20 of the wrench head, a counterpart 7 arranged to slide on strap 3. This counterpart 7, a detailed view of which is shown in FIG. 1*c*, is arranged in contact with assembly element 5 in an opposite position to support body 20. This counterpart 7 preferably includes, in a similar way to support body 20, two support faces 71 and 72 intended to come into contact with the faces of assembly element 5. Counterpart 7 advantageously allows the holding of assembly element 5 to be made more rigid and thus the grip of the universal wrench thereon to be improved. The angle formed by the two support faces 71 and 72 of counterpart 7 is substantially equal to the angle formed by two successive faces of assembly element 5, namely, in this non-limiting example, an angle substantially equal to 120°.

Preferably, the universal wrench according to the present invention further includes return means elastically linking wrench head 2 to handle 1. These return mans thus force the wrench head to adopt a rest position when no external force is being applied to the handle, a rest position in which the strap is held under tension around polygonal assembly element 5. These return means can advantageously be formed of a leaf spring attached, on the one hand, to handle 1 and, on the other hand, to wrench head 2. Alternatively, these return means can be formed of a spiral or helical spring mounted concentric to rotational axis A of the wrench head. These return means are not shown in the illustration of FIGS. 1*a* and 1*b*.

FIGS. 2*a* to 2*d* which will now be described will allow the behaviour of the wrench to be shown during an opposite rotational movement to the tightening or loosening rotational movement. These Figures will also allow the addition of the return means, globally designated 9 in the Figures, elastically linking wrench head 2 to handle 1, to be shown.

The wrench which is illustrated in FIGS. 2*a* to 2*d* generally comprises the same elements as the wrench illustrated in FIGS. 1*a* and 1*b*, namely handle 1, wrench head 2 rotatably mounted with respect to handle 1, as well as strap 3 one end of which is attached to wrench head 2 and the other end is locked by tension means 4. In this example, the wrench is however shown without counterpart 7.

This wrench further includes return means 9 elastically linking wrench head 2 to handle 1 of the wrench. This return means 9 thus force the wrench head to take a rest position with respect to handle 1. This rest position is illustrated in FIG. 2*d* where no external force is applied to wrench handle 1. In this example, this rest position is defined by a substantially rectilinear position of wrench head 2 with respect to handle 1, this position of course depending on the tension applied by strap 3. These return means 9 may advantageously be formed by a leaf spring 91 fixed by its ends to handle 1 and to wrench head 2 respectively.

Figure 2A:
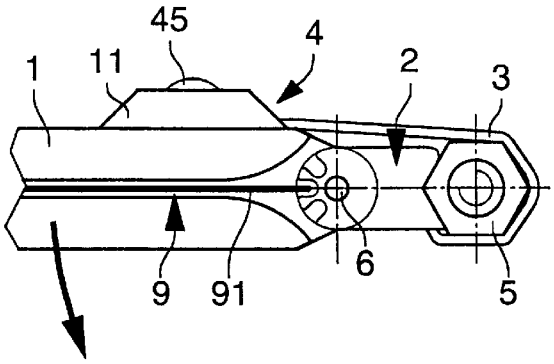
FIGS. 2*a* to 2*d* are side views of an embodiment of a universal wrench according to the present invention, similar to the illustration of FIGS. 1*a* and 1*b*, illustrating four successive positions of the wrench during a relaxation or return rotational movement, i.e. a rotational movement opposite to the rotational movement applied to the assembly element having to be tightened or loosened.

FIG. 2*a* illustrates the wrench in the normal gripping position on assembly element 5. In this position, a rotational movement of the wrench in the direction indicated by the arrow in FIG. 2*a*, i.e. in the anticlockwise direction, generates a torque, in this case a loosening torque, on assembly element 5.

Figure 2B:
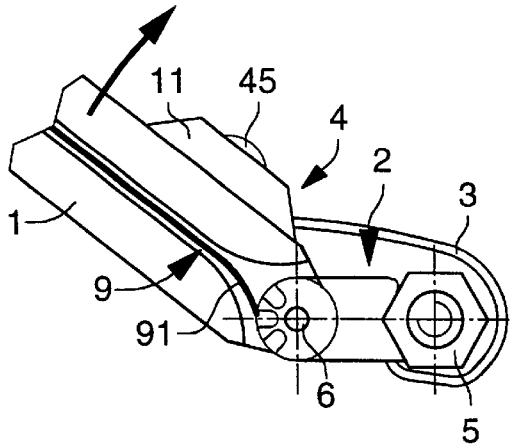

In order to release the grip and to take a more accessible angle of assembly element 5, an opposite rotational movement to the loosening rotational movement, namely a rotational movement in the clockwise direction as indicated in FIG. 2b, causes opposite pivoting of wrench head 2 and allows strap 3 to relax and wrench head 2 to disengage from assembly element 5 without however losing its grip thereon since the strap still surrounds it.

Figure 2C:
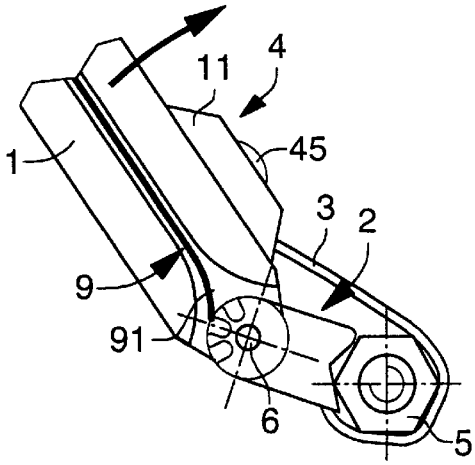
Figure 2D:
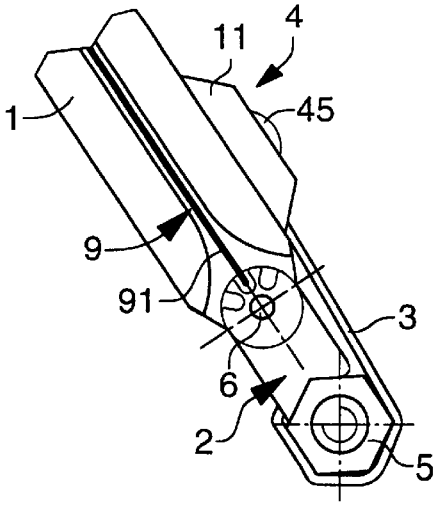

As is illustrated in FIG. 2*c*, wrench head 2 can thus slide over assembly element 5 via the rotational action of the wrench and grip the next angle of assembly element 5. Return means 9 then force wrench head 2 to recover its rest position and tighten again strap 3 around assembly element 5. In this rest position, illustrated in FIG. 2*d*, the wrench is thus again in a position allowing a loosening torque to be applied to assembly element 5.

Generally, it can be seen that this mechanism behaves in a similar way to a ratchet mechanism, i.e. the wrench is held gripping the assembly element when the latter is subjected to a tightening or loosening rotational movement and can however slide or jump an angle of the assembly element when it is subjected to a relaxation or return rotational movement opposite to the tightening or loosening rotational movement.

Return means 9 thus advantageously allow assembly element 5 to be loosened or tightened without having to effect a complete rotation of the wrench. It will easily be understood that this is particularly advantageous in the event that the assembly elements to be screwed or unscrewed are located in inaccessible positions.

FIGS. 3*a* and 3*b* illustrate a universal wrench constituting a second embodiment of the present invention. For the sake of simplification, one has chosen to designate the elements common to this embodiment and the embodiment of FIGS. 1*a* and 1*b* by the same numerical references. This wrench thus includes a handle 1, a wrench head, designated 2' in this Figure, rotatably mounted with respect to handle 1 and provided with a support body 20, a strap 3 and tension means, designated 4' in this Figure.

Unlike the first embodiment, it will be noted that strap 3 is arranged to pass between rotational axis A of wrench head 2' and rotational axis B of polygonal assembly element 5 to be tightened or loosened prior to being held by tension means 4. The inventor was able to observe that this particular arrangement of strap 3 allowed the grip of the wrench on assembly element 5 to be further improved and any risk of the wrench becoming disengaged during a tightening or loosening rotational movement, or during a relaxation rotational movement, to be greatly limited.

In order to allow wrench head to rotate an angle as large as possible so that tension of the strap 3 is assured, the wrench is preferably generally L-shaped in its gripping position as illustrated in FIG. 3, in which wrench head 2' is arranged substantially at right angles to handle 1 and is arranged so as to grip polygonal assembly element 5 to be tightened or loosened in an off-centre position substantially parallel to a longitudinal axis of handle 1, designated C in FIG. 3*a*.

Unlike the first embodiment, it will also be noted that the tension means designated 4' are made by means of two moving elements associated with handle 1 between which end 32 of strap 3 is held. More specifically, tension means 4' include in this example, a first moving element called a tongue member 47 which is rotatably mounted with respect to handle 1, as well as a second moving element called a excentric member 48 which is also rotatably mounted with respect to handle 1. Excentric member 48 amplifies the pressure of the strap against tongue member 47 as a result of a lever effect due to its elongated and off-centre shape. The two elements moving about their axes thus clamp and therefore hold strap 3 when it is placed under tension. By raising tongue member 47 by a rotation in the anti-clockwise direction as illustrated in FIG. 3*a*, strap 3 can be released in order to adjust the useful length or in order to release the grip on assembly element 5.

It will be understood that the universal wrench illustrated in FIGS. 3*a* and 3*b* essentially behaves in the same way as shown hereinbefore, i.e. a tightening or loosening rotational movement causes an increase in the tension in strap 3 and an opposite rotational movement causes relaxation or strap 3 via rotation of wrench head 2'. Thus, in the illustration of FIG. 3*a*, by a rotational movement in the direction indicated by the arrow in the Figure (in the anti-clockwise direction), assembly element 5 is subjected to a loosening torque, this rotational movement causing an increase in the tension of strap 3.

The return means, designated 9' in FIGS. 3*a* and 3*b*, are formed in this example of a spring 92 of helical shape, arranged concentric to rotational axis A of wrench head 2' with respect to handle 1. One end of this spring 92 is held pressed against handle 1 while the other end is secured to wrench head 2' as can be seen in FIG. 3*b*. Like the return means illustrated in the preceding Figures, they preferably and advantageously allow strap 3 to be automatically placed under tension during a rotational movement opposite to the tightening or loosening rotational movement.

FIG. 4 describes another embodiment of the universal wrench according to the present invention. This embodiment is substantially similar to the embodiment illustrated with reference to FIGS. 3*a* and 3*b*, therefore one will not dwell on the significant differences between these two embodiments.

According to this other embodiment of the present invention, the tension means of strap 3 do not actually use any additional holding element as in the preceding embodiments. The peculiarity of this embodiment lies in the fact that strap 3 is simply held under tension by articulation pin 6 of wrench head 2' with respect to handle 1. According to this example, articulation pin 6 is rotatably fixed to handle 1 and is provided with a slit 6*a* through which strap 3 is inserted.

It will be noted that the return means with which the wrench is preferably provided are not illustrated in FIG. 4. It will be understood nonetheless that they can be made as previously described, for example by means of a leaf spring as illustrated in FIGS. 2*a* to 2*d*.

It will thus have been understood that various mechanisms can be envisaged by those skilled in the art to place and hold strap 3 under tension. These tension means must simply answer one criterion, namely to hold the strap so as to allow an increase in the tension of the strap during a tightening or loosening rotational movement and so as to allow the strap to relax during a return rotational movement opposite to the tightening or loosening rotational movement.

Multiple modifications and/or improvements can be made to the wrench according to the present invention without departing from the scope of the invention. It will be understood in particular that the invention is not limited to the embodiments shown and that the universal wrench can for example easily be modified and adapted to handle other polygonal assembly elements than nuts or bolt heads with six flats. In particular, one may envisage providing support bodies of various shapes suited to the different types of assembly elements found on the market. It is thus perfectly possible to envisage providing a set of support bodies suited to each type of assembly element, these support bodies being able to be mounted in a removable manner and to be interchanged on the wrench head.

What is claimed is:

1. A universal wrench for tightening or loosening polygonal assembly elements selected from the group consisting of nuts, bolt heads and polygonal tube sleeves, this universal wrench including a wrench body provided with a handle and a wrench head arranged at one end of said handle and adapted to come into contact with one of said polygonal assembly elements to be tightened or loosened, said wrench head including a support body able to accommodate said one polygonal assembly element, wherein the wrench further includes:

a flexible strap-shaped element adapted to surround and hold the polygonal assembly element against said support body, one end of said flexible strap-shaped element being fixed to said wrench head, and tension means associated with the handle and adapted to act on an opposite end of the flexible strap-shaped element in order to place and hold said flexible strap-shaped element under tension, said wrench head being rotatably mounted with respect to said handle about a rotational axis parallel to a rotational axis of the polygonal assembly element to be tightened or loosened, so that a tightening or loosening rotational movement causes an increase in the tension of said flexible strap-shaped element thus assuring that the wrench is held gripped on an angle of the polygonal assembly element, and so that a return rotational movement opposite to the tightening or loosening rotational movement causes the flexible strap-shaped element to relax thus allowing said wrench head to slide and grip another angle of the polygonal assembly element, said wrench head being resiliently linked to said handle by return means arranged to automatically place said flexible strap-shaped element under tension during said return rotational movement opposite to the tightening or loosening rotational movement.

2. The universal wrench according to claim 1, wherein said return means comprises a leaf spring fixed to said wrench head and to said handle.

3. The universal wrench according to claim 1, wherein said return means comprises a spiral or helical spring mounted concentric to the rotational axis of said wrench head.

4. The universal wrench according to claim 1, wherein said flexible strap-shaped element is arranged to pass between the rotational axis of the wrench head and the rotational axis of the polygonal assembly element to be tightened or loosened prior to being held by said tension means.

5. The universal wrench according to claim 1, wherein said support body includes at least one support face made rough in order to increase adherence of said wrench head to said polygonal assembly element.

6. The universal wrench according to claim 1, wherein said support body includes at least two support faces adapted to come into contact with faces of said polygonal assembly element.

7. The universal wrench according to claim 1, wherein a bevelled or rounded edge is made at one end of said support body in order to facilitate sliding of said wrench head during said return rotational movement.

8. The universal wrench according to claim 1, wherein said wrench further includes a counterpart arranged on said flexible strap-shaped element and adapted to be positioned on the polygonal assembly element in an opposite position to said support body.

9. The universal wrench according to claim 1, wherein said flexible strap-shaped element is a textile strap.

10. The universal wrench according to claim 1, wherein said wrench head is arranged so as to grip said polygonal assembly element in an off-centre or asymmetric position with respect to a plane comprising the rotational axis of the wrench head and the rotational axis of the polygonal assembly element.

11. A universal wrench for tightening or loosening polygonal assembly elements selected from the group consisting of nuts, bolt heads and polygonal tube sleeves, this universal wrench including a wrench body provided with a handle and a wrench head arranged at one end of said handle and adapted to come into contact with one of said polygonal assembly elements to be tightened or loosened, said wrench head including a support body able to accommodate said one polygonal assembly element, wherein the wrench further includes:

a flexible strap-shaped element adapted to surround and hold the polygonal assembly element against said support body, one end of said flexible strap-shaped element being fixed to said wrench head, and tension means associated with the handle and adapted to act on an opposite end of the flexible strap-shaped element in order to place and hold said flexible strap-shaped element under tension, said wrench head being rotatably mounted with respect to said handle about a rotational axis parallel to a rotational axis of the polygonal assembly element to be tightened or loosened, so that a tightening or loosening rotational movement causes an increase in the tension of said flexible strap-shaped element thus assuring that the wrench is held gripped on an angle of the polygonal assembly element, and so that a return rotational movement opposite to the tightening or loosening rotational movement causes the flexible strap-shaped element to relax thus allowing said wrench head to slide and grip another angle of the polygonal assembly element, said wrench head being arranged so as to grip said polygonal assembly element in an off centre or asymmetric position with respect to a plane comprising the rotational axis of the wrench head and the rotational axis of the polygonal assembly element.

12. The universal wrench according to claim 11, wherein said wrench head is also resiliently linked to said handle by return means arranged to automatically place said flexible strap-shaped element under tension during said return rotational movement opposite to the tightening or loosening rotational movement.

13. The universal wrench according to claim 12, wherein said return means comprises a leaf spring fixed to said wrench head and to said handle.

14. The universal wrench according to claim 12, wherein said return means comprises a spiral or helical spring mounted concentric to the rotational axis of said wrench head.

15. The universal wrench according to claim 11, wherein said flexible strap-shaped element is arranged to pass between the rotational axis of the wrench head and the rotational axis of the polygonal assembly element to be tightened or loosened prior to being held by said tension means.

16. The universal wrench according to claim 11, wherein said support body includes at least one support face made rough in order to increase adherence of said wrench head to said polygonal assembly element.

17. The universal wrench according to claim 11, wherein said support body includes at least two support faces adapted to come into contact with faces of said polygonal assembly element.

18. The universal wrench according to claim 11, wherein a bevelled or rounded edge is made at one end of said support body in order to facilitate sliding of said wrench head during said return rotational movement.

19. The universal wrench according to claim 11, wherein said wrench further includes a counterpart arranged on said flexible strap-shaped element and adapted to be positioned on the polygonal assembly element in an opposite position to said support body.

20. The universal wrench according to claim 11, wherein said flexible strap-shaped element is a textile strap.

* * * * *